US005878003A

United States Patent [19]

Gantet

[11] Patent Number: 5,878,003

[45] Date of Patent: Mar. 2, 1999

[54] MYSTERY CLOCK

[75] Inventor: Gérard Gantet, Cachan, France

[73] Assignee: Van Cleef & Arpels, Paris, France

[21] Appl. No.: 836,638

[22] PCT Filed: Sep. 18, 1996

[86] PCT No.: PCT/FR96/01454

§ 371 Date: May 19, 1997

§ 102(e) Date: May 19, 1997

[87] PCT Pub. No.: WO97/11412

PCT Pub. Date: Mar. 27, 1997

[30] Foreign Application Priority Data

Sep. 18, 1995 [FR] France ..... 95/10912

[51] Int. Cl.[6] ..... G04B 19/00; G04B 19/06; G04B 19/20

[52] U.S. Cl. ..... 368/76; 368/77; 368/223; 368/233

[58] Field of Search ..... 368/76, 77, 80, 368/223, 229, 232–234

[56] References Cited

U.S. PATENT DOCUMENTS

| | | | |
|---|---|---|---|
| 2,466,312 | 4/1949 | Heintz | 368/77 |
| 2,749,904 | 6/1956 | Heikkila . | |
| 5,297,121 | 3/1994 | Sepehri | 368/228 |
| 5,349,512 | 9/1994 | Belik | 368/223 |

FOREIGN PATENT DOCUMENTS

| | | |
|---|---|---|
| 2034632 | 12/1970 | France . |
| 2632426 | 12/1989 | France . |
| 2044355 | 3/1972 | Germany . |
| 86 20 030.5 | 11/1987 | Germany . |
| 4330895 | 3/1995 | Germany . |
| 676074 | 12/1990 | Switzerland . |
| 94/04965 | 3/1994 | WIPO . |

*Primary Examiner*—Vit W. Miska
*Attorney, Agent, or Firm*—William H. Holt; William R. Hinds

[57] ABSTRACT

A clock, called a "mystery" clock because of its almost totally transparent nature, comprising a transparent dial bearing reference markers (11), a minute indicator, transparent except in the area of a reading pointer (28') and an hour indicator, also transparent except in the area of a reading pointer (26'), indicators and dial having a common geometric axis (Y) and being carried by a frame or surround (20) and at least part of these indicators and dial having teeth at their periphery, masked by the surround (20), for driving them in rotation, in relation to the surround (20), about said axis (Y).

16 Claims, 8 Drawing Sheets

MYSTERY CLOCK

The present invention concerns a clock and, more particularly, a so-called 'mystery' clock, so-called because of its almost total transparency.

Such clocks are produced in the form of a fixed frame having a circular opening in which transparent discs, which are driven at their periphery, are arranged.

Such clocks are well-known in the state of the art and, by way of example, patent document FR-A-2,632,426, describing a mystery clock of a particular kind, with extensile hands, can be referred to.

In all state of the art mystery clocks, the cross-sectional form of the transparent discs concerned corresponds to the form and size of the clock opening, so that each disc turns around its fixed axis.

The object of the present invention is to propose a clock which adds to the surprise effect, through the movement of axes of discs or the like, while preserving an apparent absence of connection between the hands or the like and the clock driving mechanism.

It has already been proposed, in conventional clocks, that there be construction enabling surprise effects through the movement of the geometrical axis of rotation of the hour- and/or minute-indicators, or through a shift or partial removal of normal reading elements (dial, hour-indicator, minute-indicator).

Thus, in patent document DE-A-2,044,355, it is envisaged that an hour- or minutes-indicating circular disc (or ring), while turning around its geometrical axis, can be moved bodily in relation to a ring (or a disc) with a fixed axis, following a rotational movement without slipping, by means of gearing for example, in which the said geometrical axis describes a circle. The time is read through visual assessment of the relative position of the ring and of the disc.

As another example, patent document WO-A-94,04965 describes a clock comprising a casing which turns at a constant speed in a clockwise direction, about a fixed axis, and carries eccentrically, a conventional clock-mechanism controlling the rotation of said casing and that of a minute-indicating pointer. A conventional, graduated dial is positioned behind the minute-indicating pointer, a it is ballased in such a way that it maintains its fixed angular position through gravity, by itself, that is, so that the 12 o'clock–6 o'clock-line is always vertical. The casing concerned comprises an hour-marker or pointer, a pointer for example. The hour is read on the basis of the angular position of the said casing in relation to the dial and the minutes are read in the usual way from the position of the pointer in relation to said dial positioned behind it.

In these known devices, reading of the time is very impractical because the hour- and minute-indicators are not coaxial and are spaces in relation to each other, the user therefore having to make an unusual optical or visual assessment of the relative positioning of two elements. Moreover, these devices are not applicable to so-called 'mystery' clocks because discs or similar indicators have to mask the mechanism and therefore cannot be transparent.

The object of the present invention is therefore to propose a 'mystery' clock which, while enabling easy reading of the time through a coaxial arrangement of hour and minute indicators, has another surprise effect through the movement of the geometrical axes of rotation of these indicators in relation to each other.

To this end, the present invention proposes a so-called 'mystery' clock comprising a transparent dial bearing reading markers, a minute-indicator, transparent except in the area of a reading-pointer, and an hour-indicator, also transparent except in the area of a reading-pointer, indicators and dial having a common geometric axis Y and being carried by a frame or surround, and at least part of these indicators and dial having teeth at their periphery, masked by the surround, for driving them in rotation in relation to the surround about said axis Y, characterized in that it also includes:

- a fixed frame having a fixed geometric axis X and movingly carrying said surround,
- first driving means, for rotating said surround and said dial and indicators which it carries, about said fixed axis X, in a pre-determined direction and at a pre-determined angular speed, and
- second driving means, for rotating a part at least of said dial, minute-indicator and hour-indicator by their periphery, about said axis Y of said surround, in order that said indicators turn, one in relation to the other and relative to said dial for instantaneous indication of the time due to the relative angular position of said indicators in relation to said dial.

Advantageously, for reasons of simplicity, said second driving means are arranged so that the dial remains in a fixed angular position.

For example, the second driving means co-operate, through gearing, with a fixed toothed annular gear carried by said fixed frame.

In accordance with a preferred embodiment, the second driving means comprise a gear train with at least one input gear wheel and at least two output gear wheels functioning, respectively, through gearing, with this annular gear and the cogged periphery of at least a part of said dial and indicators carried by said surround.

In accordance with one embodiment, said gear train extends between the annular gear and the cogged periphery of at least one part of said dial and indicators, this train being carried by a moving element which fixedly supports the surround and which is concealed by an ornamental element.

As a variant, the surround is substantially tangentially aligned in relation to the fixed frame and the gear train is carried by a moving element which fixedly carries said surround and is partly housed within said fixed frame and partly housed inside said surround, in said area of tangency of the fixed frame and said surround.

In accordance with another embodiment, the second driving means comprise at least two floating annular gears housed in a fixed frame and each functioning together with, on the one hand, the cogged periphery of one of the said dial and indicators carried by the surround and, on the other hand, with a driving gear wheel housed in said fixed frame.

Advantageously, the clock concerned comprises a moving element comprising a first time-indicating part and a second part concealing a part of said second driving means and extending from said first part to the inner contour of said fixed frame.

In this case, said second part of the moving element is transparent or void except in an area concealing said part of said second driving means.

For example, said geometrical axes X and Y are joined or are distinct, the surround being, in the latter case, tangentially arranged in relation to said inner contour of the fixed frame or spaced in relation to it.

In accordance with one embodiment, the clock is characterized in that first driving means are arranged so that they drive the surround, and the dial and indicators which it carries, in a clockwise direction, as seen by an observer, at an angular speed of 1/12 revolutions per hour, and in that an hour-indicator is integrated with said surround, and in that the second driving means comprise an output gear wheel for a minute-indicator and an output gear wheel for the dial.

In accordance with another embodiment, the clock is characterised in that the first driving means are arranged to drive the surround, and the dial and indicators which it carries, in a clockwise direction, as seen by an observer, at an angular speed of one revolution per hour, in that the minute-indicator is integrated with said surround, and in that the second driving means comprise an output gear wheel for the hour-indicator and an output wheel for said dial.

In general terms, from the point of view of kinematics, the second driving means are arranged so as to drive the rotation, in relation to the surround, of the minute-indicator at an angular speed $V_{mn}$ expressed in revolutions/hour, the hour-indicator at an angular speed $V_h$, expressed in revolutions/hour and the dial concerned at an angular speed $V_c$ expressed in revolutions/hour, according to the following relationships:

$$V_{mn}=1-\epsilon V_l$$

$$V_h=\tfrac{1}{12}\epsilon V_l$$

$$V_c=-\Theta V_1$$

in which $V_l$ is expressed in revolutions/hour, the positive numerical value (absolute value) of angular velocity of said surround about an axis X,$\epsilon$−+1 if the surround revolves in a clockwise direction and −1 if it revolves in an anti-clockwise direction, volocities $V_{mn}$, $V_h$ and $V_c$ being positive for rotation in a clockwise direction and negative for rotation in an anti-clockwise direction in relation to said surround.

In accordance with one particular embodiment, the fixed frame has a circular opening in which said surround, and the dial and indicators which it carries, revolve about said fixed axis X of the fixed frame, said surround being part of a moving element extending, at least in part, as far as the edge of said circular opening, this moving element being transparent or void outside said surround, except in at least one area concealing said first and/or second driving means.

Advantageously, at least one part of said dial and indicators is comprised of transparent, circular discs carrying markings or other orientation points. In certain cases, one of said indicators can comprise an indicator-pointer fixedly carried by said surround.

The invention will be better understood on reading the following description of non-limitative embodiments, referring to accompanying drawings which form part of the description and in which.

Figure 9:
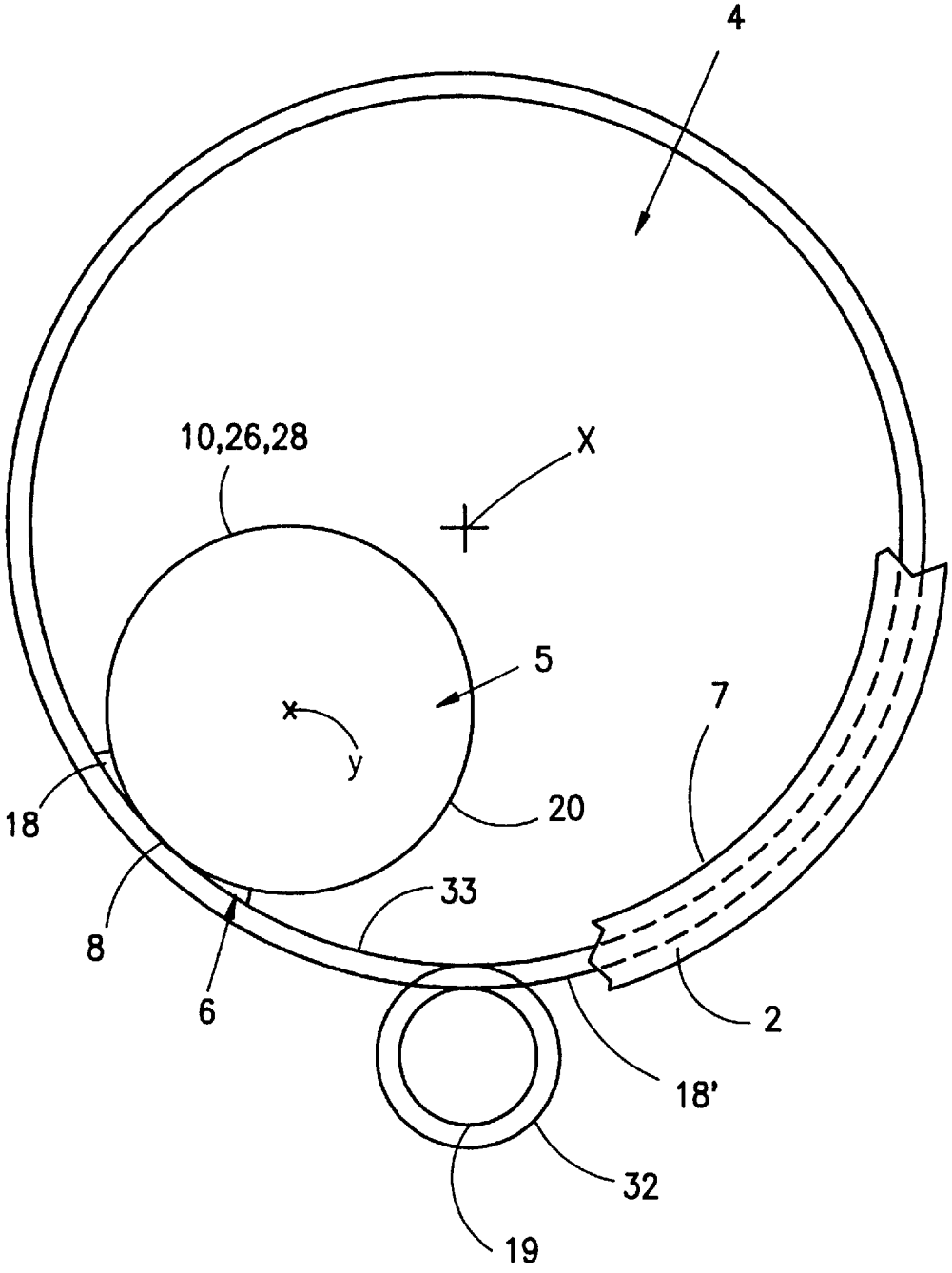

FIG. 9 diagrammatically shows another variant.

Figure 1:
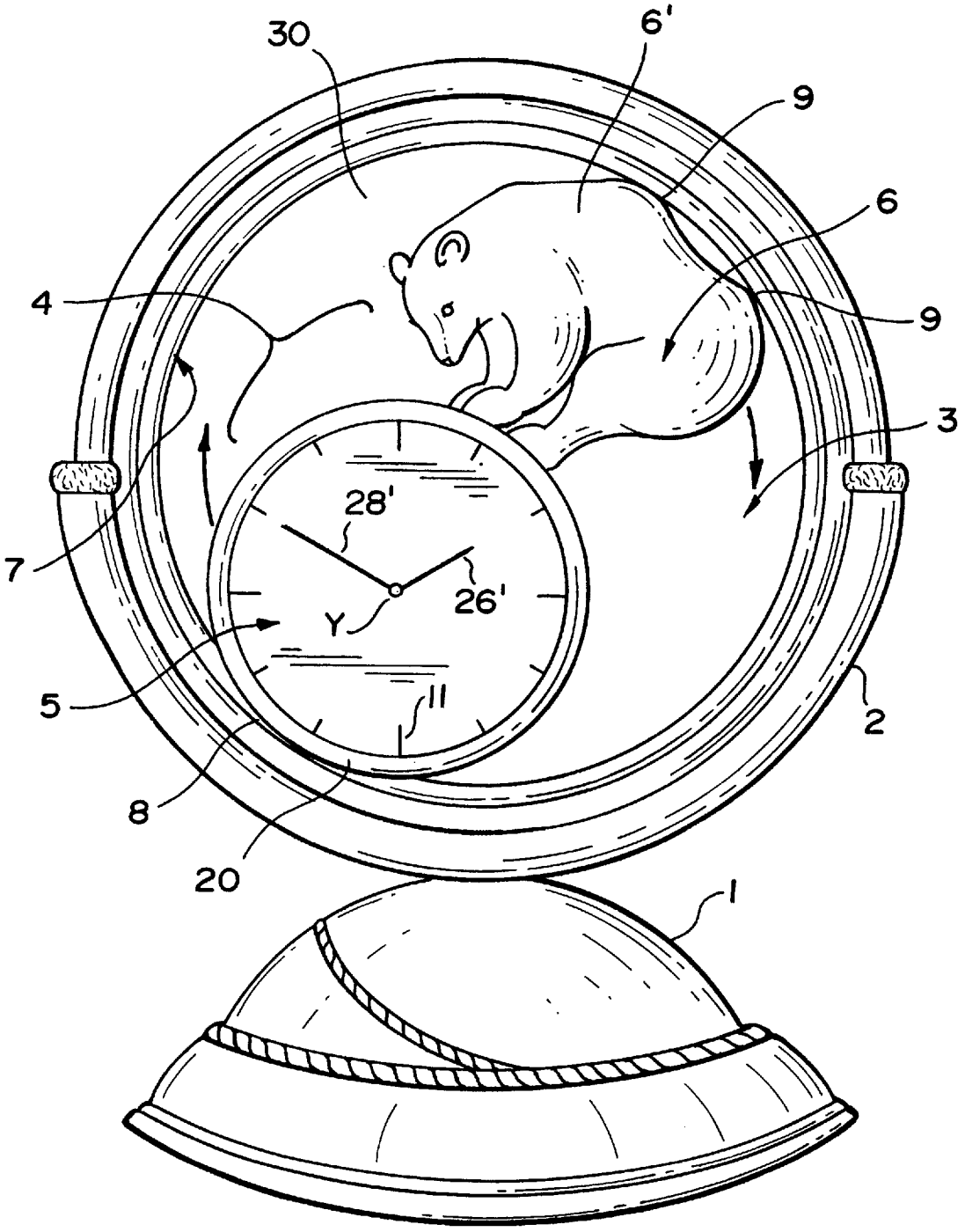
FIG. 1 shows an external front-view of a clock in accordance with a preferred embodiment of the present invention.

FIG. 1 shows a front-view of a first embodiment of a clock in accordance with the present invention. It comprises a base (1) inside which the clock movement is housed. A fixed frame (2), in the form of a ring surrounding an opening (3) which is likewise circular, is mounted directly onto this base. A moving device or element (4), which comprises a first circular part (5) for reading or indicating the time and a second part (6), supporting at least one opaque, ornamental element (6'), an animal figurine in this case, are disposed inside this opening (3).

The first part (5) comprises a circular surround (20) which holds and supports the time-indicating means, as described below. This part (5) is totally transparent, apart from its surround (20) and time-indicating means—pointers, gradations or numbers—which thereby appear to be suspended in the air. The second part (6) can complete, by its crescent- or ring-shaped form, the circular form of said part (5) of a moving element (4), as far as the circular, inner rim (7) of the fixed frame (2); this second part is, then, preferably transparent except in the area of the ornamental element (6') which conceals the driving means for the time-indicating means, as described below, so that, for the user, light can pass through it except in the area corresponding to that of the ornamental element (6') However, in a preferred variant, said part (60) is void except in the area of the ornamental element (6'); in this preferred variant there are, then, two first voids within the frame (2), on both sides of the moving devices (4), and a third void inside the surround of the circular part (5) of this device.

The moving device (4) revolves around a fixed axis X which is the common axis of the circles defining the moving device (4) and the inner rim (7 ) of the fixed frame (2); on the outside, said moving device (4) is received into said fixed frame (2), slightly penetrating into this in at least two areas (8, 9) which are positioned diametrically opposite each other. In the example described the first area (8) substantially corresponds to the point of tangency of said first part (5), and the second area (9) corresponds to two points in said second part (6).

Figure 2:
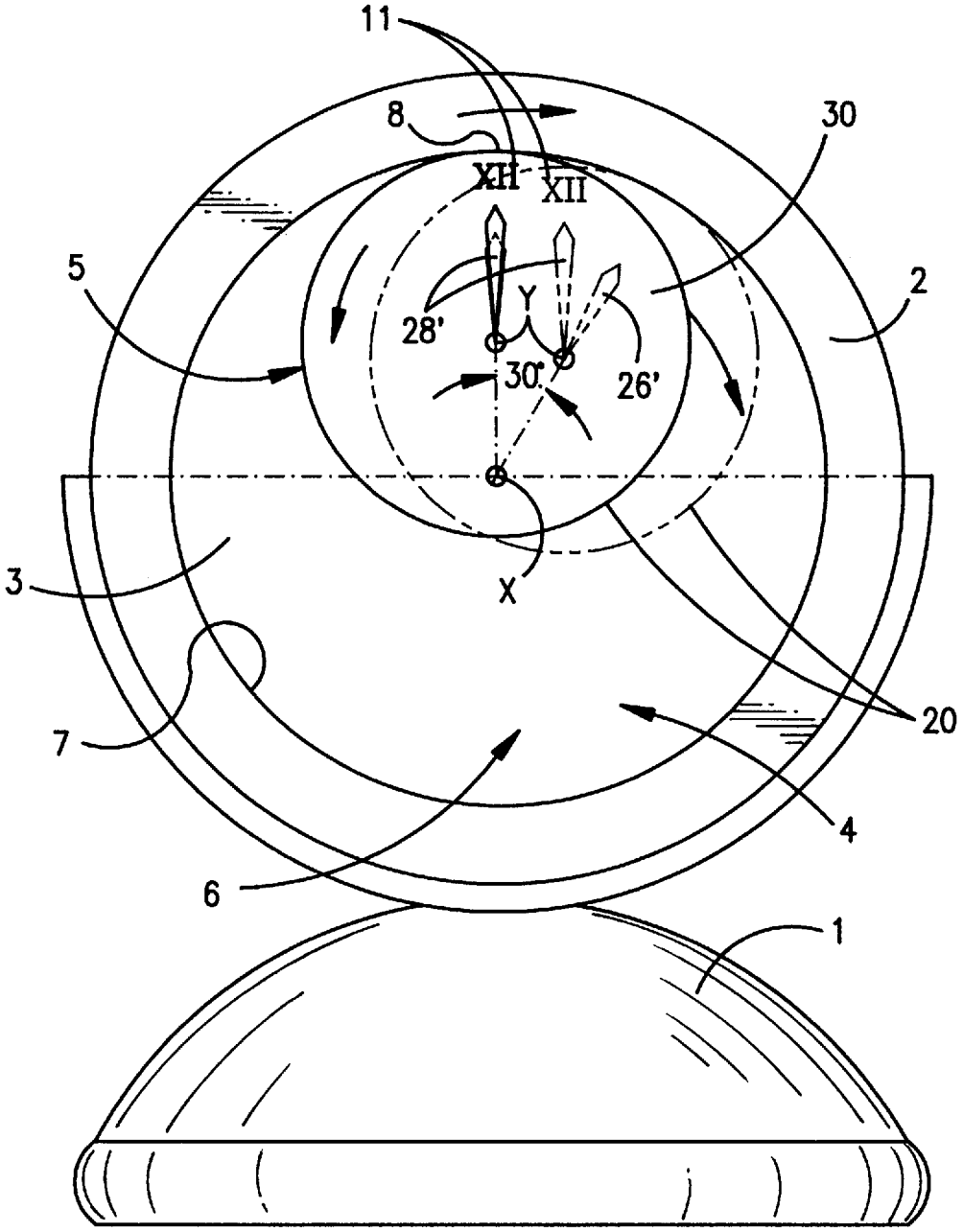
FIG. 2 shows a highly diagrammatic front-view at two different instants separated by an hour.
Figure 4:
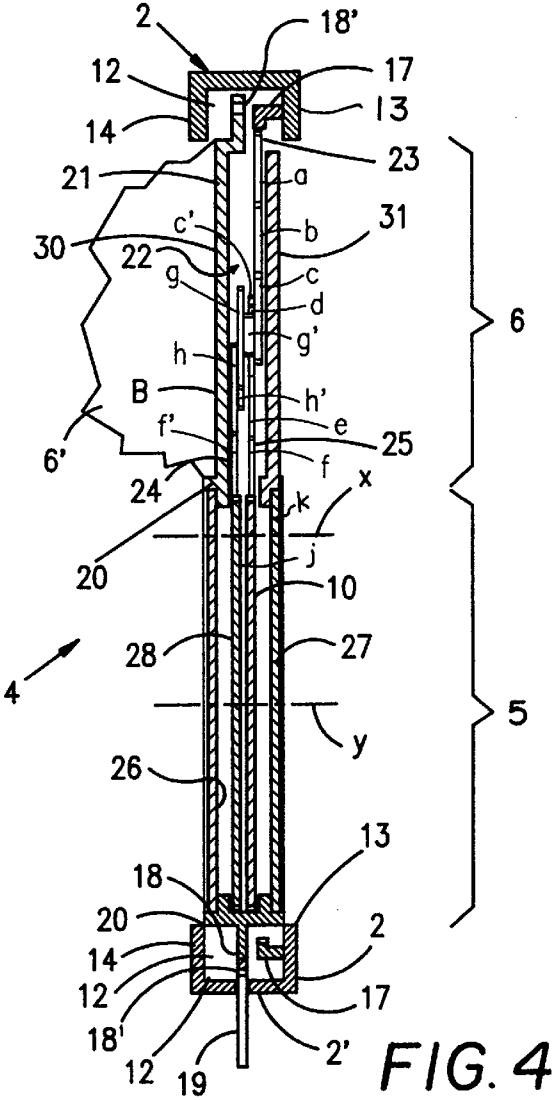
FIG. 4 shows a view of the clock along a transverse sectional line IV—IV in FIG. 3.
Figure 3:
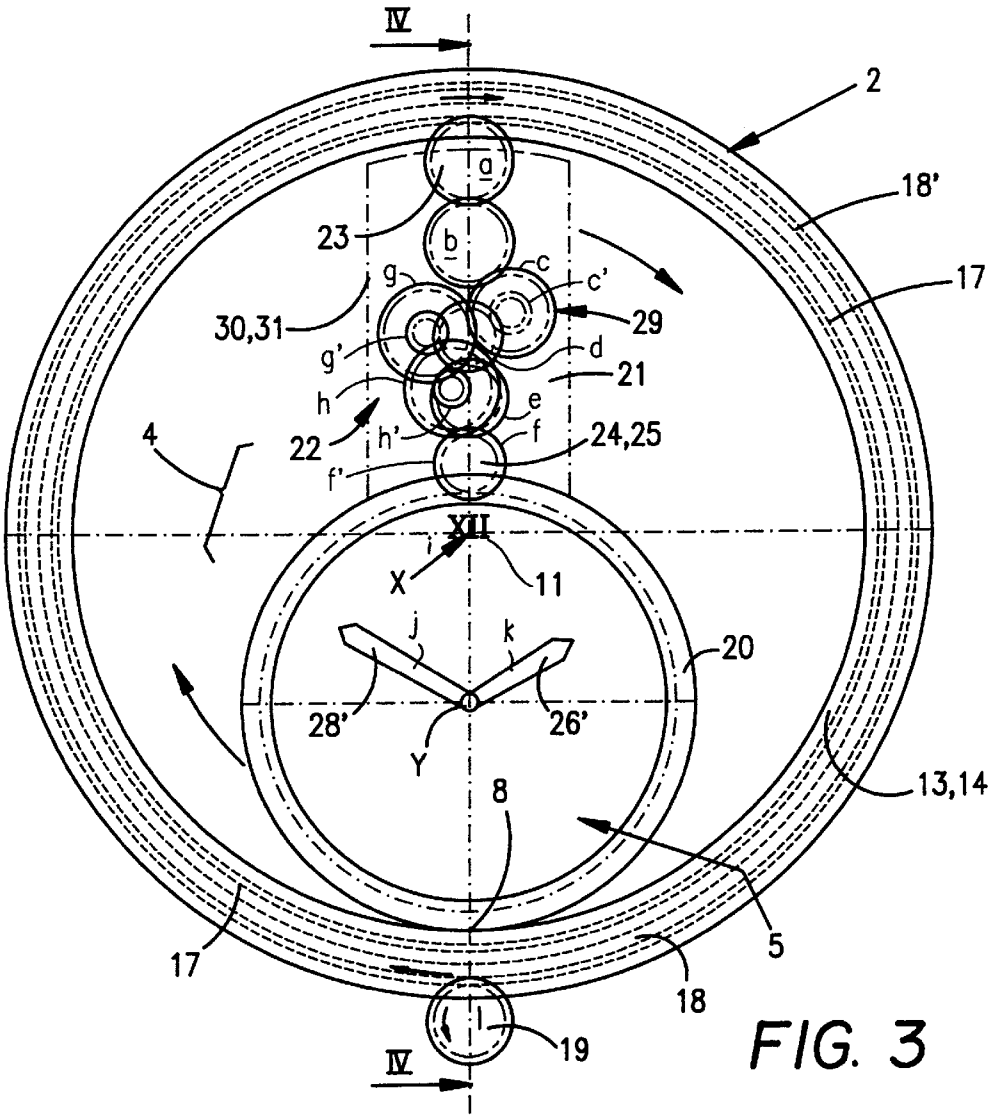
FIG. 3 shows a view of the clock in accordance with a median sectional plan and shows first and second driving means in accordance with one embodiment.

The circular surround (20) defines the outer outline of said part (5) which accommodates the time-reading and -indicating means. These means preferably consist of transparent discs, namely a dial (10) carrying the usual hour-markers (11) (graduation in FIG. 1 or numbers, just one of which is shown in FIGS. 2 and 3), a minute-disc (28) carrying 4 marking (28'), in the form of a radical pointer for example, and an hour-disc (26) carrying a marking (26') differing from marking (28'), a radial pointer, for example, which is shorter than pointer (28'), in the customary way.

Discs (10), (26) an (28) are arranged parallel and coaxially, in relation to each other in surround (20) and, as pointed out below, at least two of them can revolve in relation to this surround about the common geometrical axis Y of said surround and discs. At the rear, that is, on the side away from the observer, the part (5) is closed by a transparent, circular, protection disc (27) which is integrated with the surround (20), and retained, for example by force-fitting. In a similar way, said part (5) is closed in front by a transparent, circular, protection disc, integrated with said surround and retained in the same way. As indicated below, this disc in front can advantageously be either of discs (26) or (28), when the moving device (4) is driven in a clockwise direction, at a rate of $\tfrac{1}{12}$ revolutions per hour or, respectively, at a rate of one revolution per hour. As has been stated, discs (10), (26), (28) and the rear disc are transparent, made of a transparent plastic, for example.

Said moving element (4) and discs (10) and (28) which can turn in relation to the surround (20), are driven in rotation, respectively, in relation to the fixed frame (2), about the central fixed axis X, and in relation to said moving surround (20), about axis Y which is also that of discs (10) and (27), through engagement of their toothed, outer peripheries with a respective toothed driving means. The toothed periphery of the moving element (4) is concealed by the frame (2), and that of the moving discs carried by the part (5) is concealed by said surround (20), so that all toothed peripheries used for driving said moving device (4) and, respectively, discs (10) and (28), are invisible to the user.

The fixed frame (2) forms an external casing. In an embodiment as shown in FIGS. 1 to 4, it is formed by an annular piece having a U-shaped groove (12) oriented towards the X-axis and two sides (13, 14), one concealing a fixed ring gear (17) with inner teeth and integrated with side (13), and the other concealing an annular plate (18) which forms the outer surround of said moving element (4). This plate (18) fixedly carries, on its periphery, a ring (18') with outer teeth, driven by a gear wheel (19), with a fixed axis, which forms the output gear wheel of the movement which is housed in the base (1) and which crosses a cylindrical, central wall (2') of the fixed frame (2) to engage in a lower part of said ring (18'). The gear wheel (19) is of course concealed by the base (1) and by the sides of the fixed frame (2).

This plate (18) is extended towards the axis X, by two spaced walls (30, 31) which are preferably coplanar with the external discs (26) and (21) respectively, carried by said part (5). The walls (30, 31) are therefore each advantageously cut into to provide, within the circular periphery, a circular window defining said surround (20), discs (26) and (27) being accommodated in this window.

In the example shown, the surround (20) is tangential in relation to the fixed frame (2), however, clearly, it could be differently positioned, at a distance from said fixed frame (2), preferably remaining eccentric in relation to fixed axis X, and therefore also in relation to the fixed frame (2), so that the hour indicating part (5) can move with time. However, there is still the possibility, in a variant of the present invention, of having said part (5) centered on said axis X, in which case it would be coaxial in relation to said fixed frame (2) and would appear, to an observer, to be fully fixed, with only the ornamental element (6') seeming to revolve around said part (5), inside said fixed frame (2).

Said walls (30, 31), and preferably also the plate (18) which is integrated with them and which, advantageously, forms a single piece with them, can be either transparent or opaque, but are preferably transparent. However, walls (30, 31) can be void except in their part or parts which connects or connect the part (5) with the outside of clement (4), The surround (20) is opaque, whether because of its thickness, or because it receives, at least on the front side, a coating, covering, an imprint or suchlike, to form the outline of said time-indicating part (5) and to conceal the toothed periphery of the rotating discs (10, 28) of said part (5) and its functioning in combination with the driving-means of these. Said moving discs of part (5) rest on the base of the surround (20) where, preferably, all are mounted on the central final axis Y which is shared by front and rear discs (10) and (27) respectively.

Walls (30, 31) support the gear train (2) for driving the rotating discs. This gear train (22) is concealed from the viewer by the ornamental element (6') which extends from the surround (20) to the visible, outer outline of the moving element (4). Each wall (30, 31) can be reduced to a simple narrow flask (21) if the part (6), as in the preferred variant shown in FIG. 1, is void beyond element (6').

Said gear train (22) is preferably located in the area of the moving element (4) for which the distance between the surround (20) and the fixed frame (2) is the greatest, and this for reasons of bulk and positioning of said train (22).

Said train (22) comprises an input gear wheel (23) which engages in, by resting on and acting on, the fixed annular gear (17) and which drives, in its turn, a set of intermediate gear wheels (29) finishing with at least two output gear-wheels (25, 24) of the toothed disc of the dial (10) and of the toothed minute-disc (28) suspectively, in the example shown or, in certain variants, as described below, of at least one of the toothed minute and hour-discs, (28) and (26) respectively, or of both these two discs (28) and (26).

In its functioning, said gear wheel (19) rotates said moving element (4) about the axis X, by means of the ring (18'), in either direction, and at the set speed. The time-indicating part (5) therefore moves overall in accordance with this continuous rotation movement; the same therefore applies to the dial disc (10). Because the latter has to remain in the fixed angular position, that is, the '12 o'clock–6 o'clock'- line must remain vertical, transmission going from the input gear wheel (19) to the output gear wheel (26) is calculated such that the velocity of rotation of the moving element (4), about its axis X, and the rotational velocity of the dial disc (10) about its axis Y have the same numerical value and are of opposite signs. Thus, the dial disc (10) moves overall in accordance with the geometric movement, which is defined as being the circular translation for which said dial disc (10) moves parallel to itself, each of its points turning about the axis X.

Depending on the direction of rotation of the gear wheel (19) and the transmission ratio between it and the annular gear (18') of the moving element (4), the sign and value of the transmission-ratio between said gear wheel (19) and the toothed disc for minutes (28) and/or the toothed hour-disc (26) are calculated, in the way familiar to the man skilled in the art, according to the above formula, so that, in relation the fixed frame (2), and consequently in relation to the viewer, the minute-disc (28), with its pointer (28'), turns through 1 revolution per hour and the hour-disc (26), with its pointer (26'), turns through 1/12 revolutions per hour, both in the clockwise direction.

In accordance with the preferred embodiment shown in the appended drawings, the moving element (4) concerned is driven in the clockwise direction at the angular speed of 1/12 revolutions per hour, such that the hour-disc (26) is integrated with the surround (20) and therefore does not need to be driven by said gear train (22). In this case, the hour-disc (26) concerned is advantageously the above-mentioned front, transparent, protection on disc, protecting the part (5), and the gear train (22) only comprises two output gear wheels, namely the gear wheel (25) for holding the dial-disc (10) in the fixed angular position, as described above, and the gear wheel (24) for driving the minute-disc (28) such that this latter turns, in relation to the fixed mark, in the clockwise direction, through 1 revolution per hour.

This embodiment is preferred because it simplifies the mechanisms involved, because the hour-disc (26) does not need to be specially driven, because it is so fixed on part (5) that it can form the outer protection disc, and because the moving element (4) concerned can be driven at the slow speed of 1/12 revolutions per hour, in the clockwise direction, which economizes on clock-mechanisms involved. As a variant, the hour-disc (26) could therefore be replaced by the pointer linked with the said surround (20) or with the axis Y.

In accordance with one variant, not shown, yet is implemented on the same principle as that described above, the moving element (4) could be driven in the clockwise direction at a speed of 1 revolution per hour, in which case the minute-disc (28) would be integrated with the surround (20) in forming one of the outer discs described above which protect the part (5), preferably the front disc, or could be replaced by the simple pointer linked with the surround (20) and the axis Y, and the gear wheel (24) would then drive the hour-disc (26) so that it, in relation to the fixed marker, revolves around its axis Y in the clockwise direction, at the speed of 1/12 revolutions per hour, in the conventional way, that is, 11/12 revolutions per hour in the anti-clockwise direction about axis Y, in relation to the surround (20). In this variant, the dial (10) concerned would be driven by its gear wheel (25) at the speed of 1 revolution per hour, in the anti-clockwise direction, such that, once again, its '12 o'clock–6 o'clock' line remains vertical.

In all cases other than the two stated above, and in that there is the desire to keep the usual arrangement for reading, (the dial (10) in fixed angular position and hour- and minute-pointers (26') and (28') respectively, rotating in the clockwise direction in relation to a fixed reference marker at 1/12 revolutions per hour and 1 revolution per hour respectively), the gear train (22) concerned will comprise three output gear wheels. Depending on the direction and value of the speed of rotation of the said moving element (4), the sign and value of transmission ratios, as for the number of output gear wheels of said gear train (22), will be adapted to the reading configuration concerned. By way of example, this configuration could consist, in relation to the fixed reference marker, of rotation of the hour-pointer through one turn in 24 hours, in the clockwise direction, or again of rotation of the dial and/or of rotation of the hour- and minute-pointer in the anti-clockwise direction.

By way of example, figures are given below for the implementation of the preferred design as outlined above, in which the moving element (4) rotates in the clockwise direction, about its axis X, at the rate of 1/12 revolutions per hour.

A common main driving gear wheel (19) has 36 teeth and turns, in the anti-clockwise direction, at the speed of 1 revolution per hour, the annular gear (18') has 432 teeth, such that the said moving element (4) rotates in the clockwise direction at the speed of 1/12 revolutions per hour, the annular gear (17) has 400 teeth, and the dial disc (10) and minute disc (28) also have 400 teeth, though of the module which is half the module of teeth of said annular gear (17). The gear train (22) is set up and calculated so that, in relation to the viewer, the dial disc (10) concerned remains in a fixed angular position and the minute-disc (28) turns clockwise at the speed of 1 revolution per hour. For this, as verified moreover by the formulae concerned, said dial disc (10) has to be driven in the anti-clockwise direction at the speed of 1/12 revolutions per hour and the minute disc (28) has to be driven in a clockwise direction at a speed of 11/12 revolutions per hour.

Figure 5:
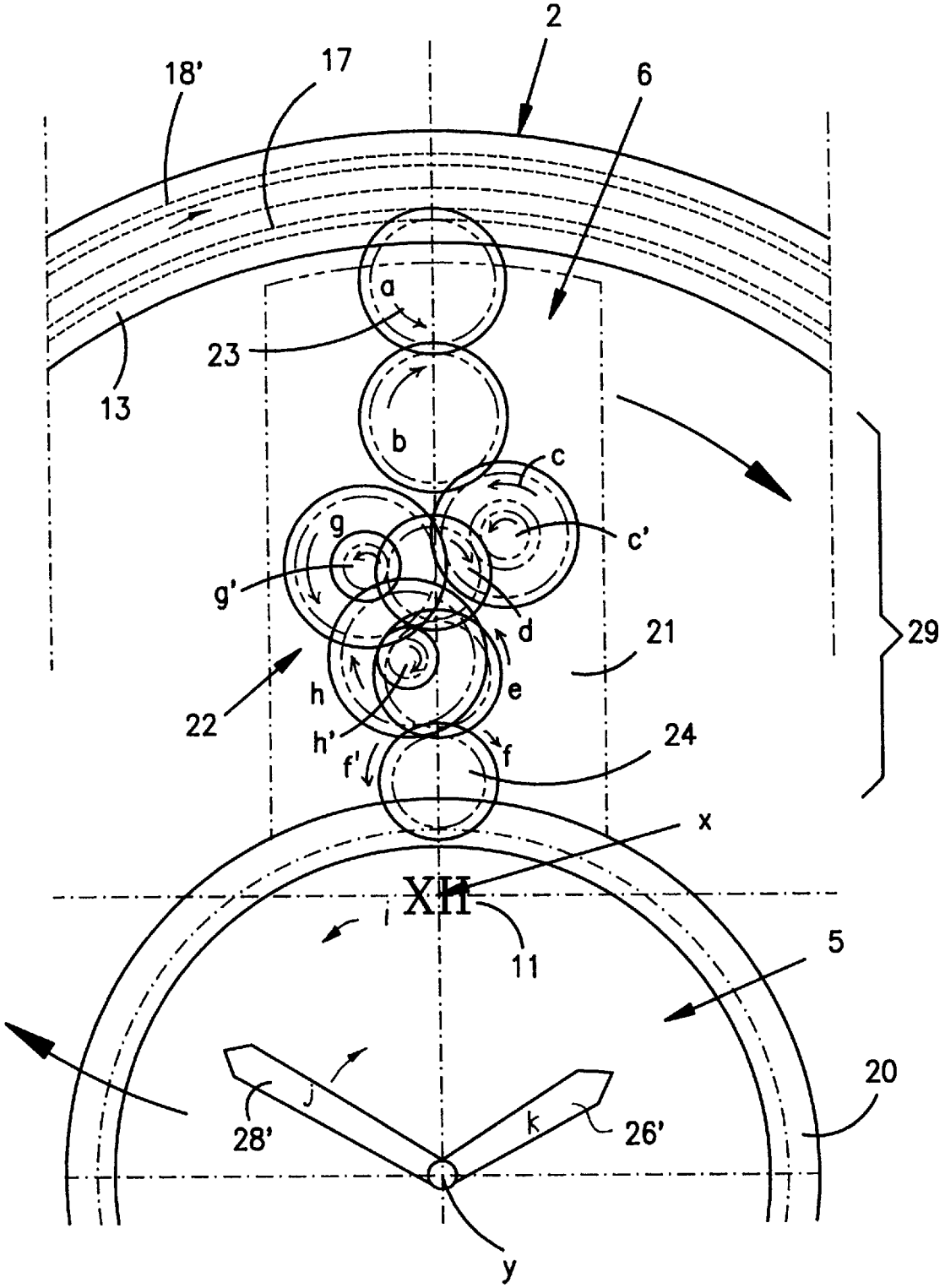
FIG. 5 shows, on a larger scale, the second driving means of a clock concerned as shown in FIG. 3.

The gear train, shown in detail in FIG. 5, enables such driving of the dial disc (10) and minute-disc (28) by common initial gear wheels (a,b,c,c',d), followed by the chain (e, f) for driving the said dial-disc (i, 10) and the chain (g,g',h,h',f) for driving the minute-disc (j, 28). Gear wheels (a,b,c), with the module of 40, furthermore equal to that of gear (17), of gear wheel (19) and of gear (18'), each have 40 teeth, while gear wheels (c',d,e,f,g',g,h',h,f), with the module of 30, have 40, 60, 60, 30, 30, 90, 24, 88 and 60 teeth respectively. The result of this is that the dial-disc (10) concerned turns at the same speed as the moving element (4), that is, 1/12 revolutions per hour, though in the opposite direction to that of the said moving element, ie. in the anti-clockwise direction, and that the minute-disc (j, 28) turns at the speed which is 11 times greater than that of the moving element (4), that is, at 11/12 revolutions per hour, in the clockwise direction.

In the variant in which the moving element is driven, clockwise at a speed of 1/12 revolutions per hour, it is necessary to provide, through applying formulae for driving of the dial-disc (10), hour-disc (26) and minute-disc (28) concerned, the gear train so that the dial-disc turns at the speed of 1/12 revolutions per hour in the clockwise direction, and that the minute-disc turns at a speed of 13/12 revolutions per hour in the clockwise direction, this in order to correct 1/12 revolutions in the a anti-clockwise direction of these two discs because of driving of the moving element concerned on which the two said discs are dependent, and so that the hour-disc turns at a speed of 2/12 revolutions per hour, likewise in the clockwise direction. That is, in this variant, the hour-disc, as in the preceding example, cannot be fixed on the moving part (5) and simultaneously be the outer disc protecting this moving part. Here, it is necessary for the said gear train (22) to have three output gear wheels and for the teeth of the third gear wheel to be linked with those of the said hour-disc (26) so that this disc is driven at the speed of 2/12 revolutions per hour in the clockwise direction. This design is clearly more complex than that provided for in the variant in which the moving element (4) is driven at the speed of 1/12 revolutions per hour in the clockwise direction (three drives instead of two) and furthermore it is necessary to have a supplementary disc for external protection of the moving part (5).

Figure 6:
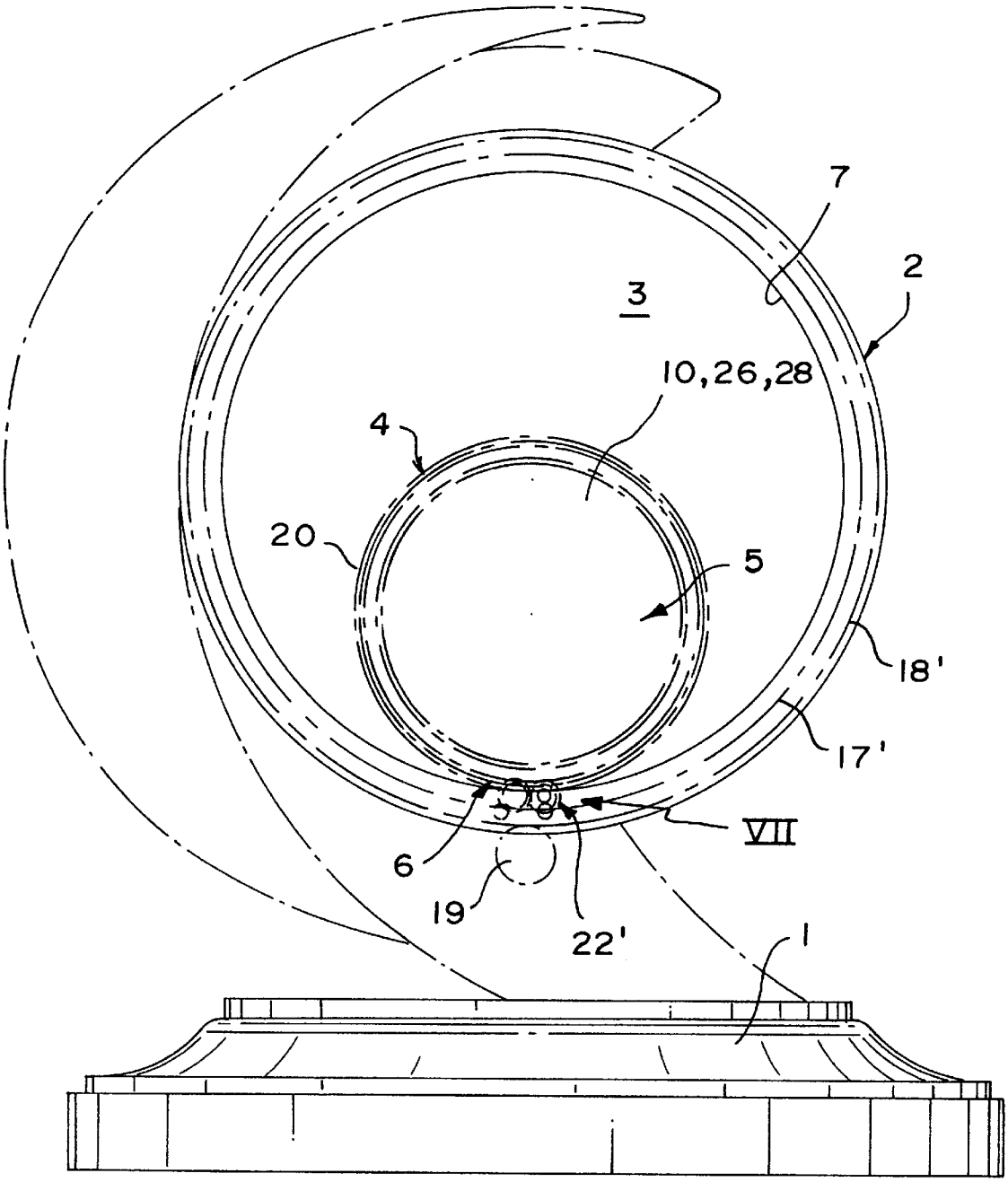
FIG. 6 is a diagrammatic front-view of a variant embodiment.
Figure 7:
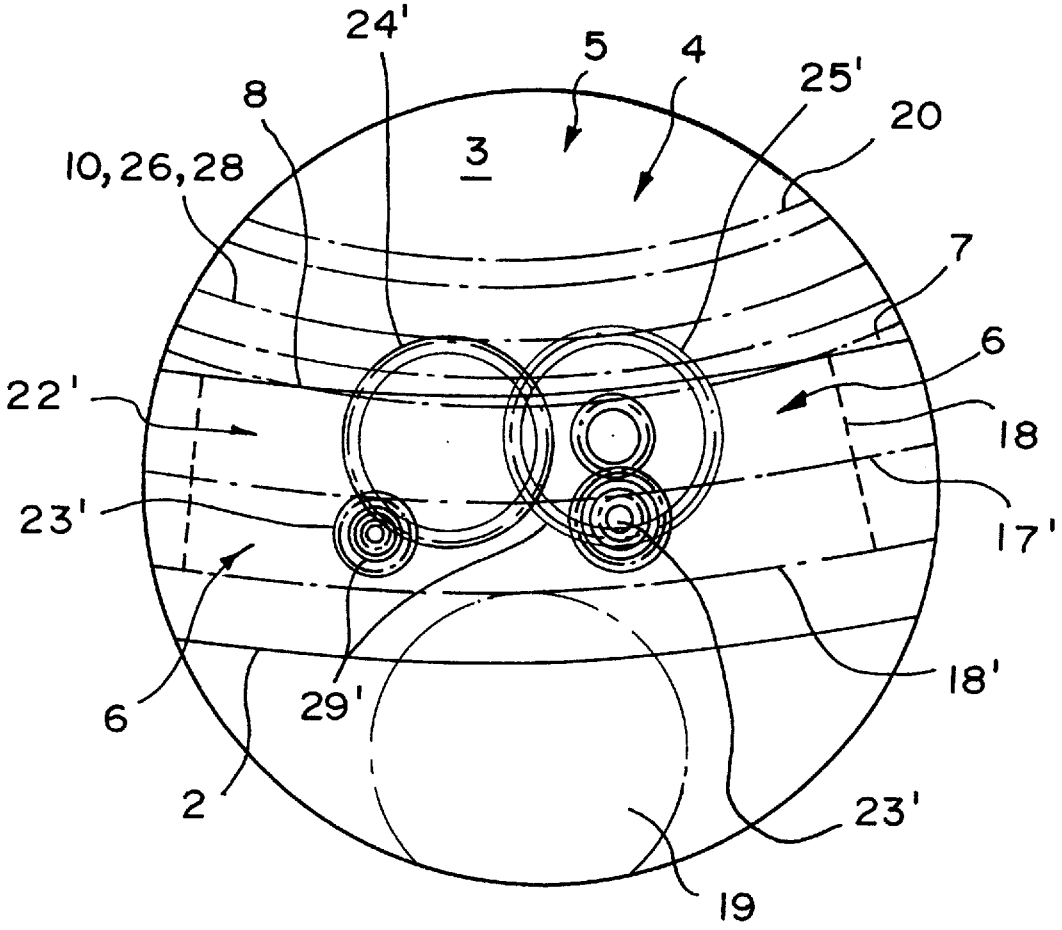
FIG. 7 shows, on a larger scale, part of FIG. 6.
Figure 8:
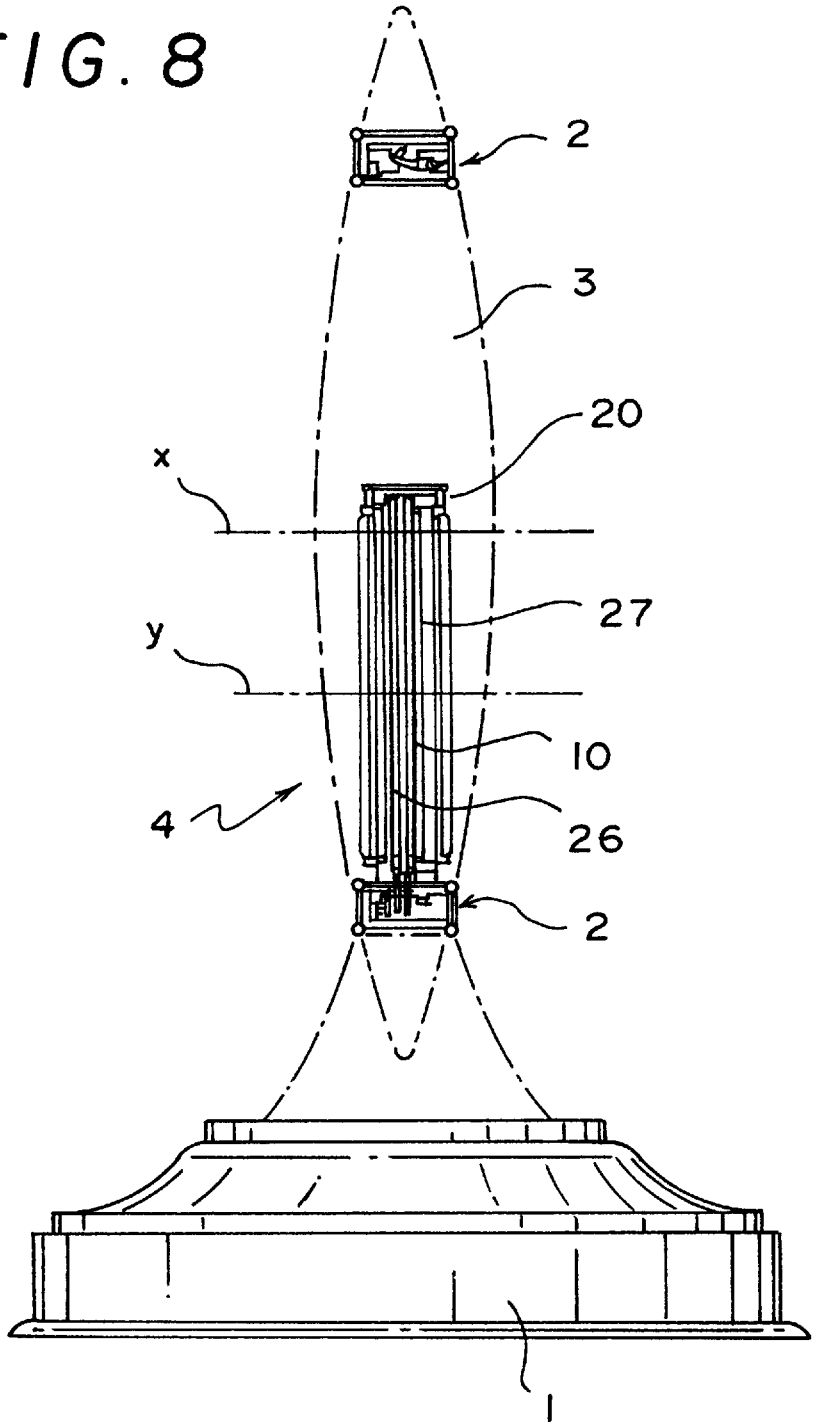
FIG. 8 shows side-view of the variation in FIG. 6.

FIGS. 6 to 8 diagrammatically show the variation of design for second driving means. In accordance with this variant, the second driving means comprise the annular gear (17'), with exterior teeth, linked to the fixed frame (2), and the gear train (22') carried by the moving element (4) and housed partly in the fixed frame (2) and partly in the surround (20), which is more or less tangential in relation to the inner rim (7) of the said frame (2). A gear train (22') comprises three input gear wheels (29') engaging with the gear ring (17'), intermediate gear wheels (29') and output, gear wheels (24', 25') engaging in those of discs (10, 26, 28) which have to be driven.

Because the surround (20) concerned is more or less tangential to the inner rim (7) or the frame (2), it is not necessary to conceal the said gear train (22') by the ornamental element, because it is already hidden by the said frame (2) and surround (20). The part (6) of the moving element (4) therefore is reduced to the small plate (18) supporting the surround (20) and the gear train (22'), the said moving element (4) then simply being made up of the surround (20) and the devices which it carries, the small plate (18) and ring (18'). As a variant, the surround (20) could be separate from the frame (2) concerned, in which case said gearing (22') would comprise gear wheels situated inside the outline of the opening (3), which would require the ornamental element to conceal them, as in FIGS. 1 to 4. In the case of tangency of the said surround (2), the said opening (3) is only occupied by the surround (20) and members which it carries.

FIG. 9 diagrammatically shows a variant which is interesting for its second drive means controlling rotation of part at least of discs (10, 26, 28) carried by the surround (20).

In accordance with this variant, the fixed ring (17, 17') is omitted and is replaced by at least two floating rings such as (33) which are received so that they are moving and concealed in the fixed frame (2), and toothed on their inner side to co-operate with the toothed periphery of the disc (10, 26, 28) to drive, preferably, in the area of tangency (8)

concerned, directly. Each annular gear (33) is likewise externally toothed to co-operate, through gearing, with the lower gear wheel such as (32) which has the fixed axis and is positioned adjacent to the gear wheel (19). Each gear wheel (32) is driven, from the drive-mechanism housed in the base, in a direction and at a speed which depends on the rotation of the moving element (4) which is controlled by the gear wheel (19) and the ring (18').

In this variant, because, as in FIGS. 6 and 8, the second driving means are housed in the base (gear wheels 32), in the fixed frame (2) gear wheels (32) and rings (33)) and in the surround of the part (5) (toothed periphery of those discs (10, 26, 28) which are to be driven), the ornamental element (6') is dispensed with and the moving element (4) is totally transparent, except as regards the surround of the said part (5), hour and minute-pointers, and graduation or suchlike of the dial disc concerned adding to the surprising and mysterious nature of the clock concerned. As a variant, the moving element (4) can be totally void or hollow outside of the surround (20); in this case, this moving element (4) is reduced to being the said part (5), the ring (18') and the small plate (18), shown diagrammatically, for mounting and for connection between said surround (20) and said ring (18').

If the surround (20) is more or less tangential to the fixed frame (2), in the area (8), discs (10, 26, 28), or part of them, directly engage with rings (33), so that the ornamental element (6') is not present and, therefore, the part (6) is made up only of the ring (18') and the small connection-plate (18).

On the other hand, if the surround is not tangential to the said frame (2), that is, if it is positioned separated from the inner rim (7) of the said frame (2), the part, at least, of discs (10, 26, 28) co-operating with rings (33) via at least one gear wheel carried by the plate (18), then the intermediate gear wheels are concealed by the ornamental element carried by the front face of the said part (18), as shown in FIGS. 1 to 4.

The invention is described above by way of example, without limiting the scope and range of this invention. Clearly, a man skilled in the art would be able to implement several variant without departing from the scope of this invention as it is defined by claims, below. For example, by applying the same principles as those described above, it is possible to provide for reading of seconds, with, in this case, addition of a toothed disc, allowing marking of seconds and a specific drive for this supplementary disc.

I claim:

1. A clock, called a "mystery" clock because of its almost totally transparent nature, comprising a transparent dial (10) bearing reference markers (11), a minute indicator (28), transparent except in the area of a reading pointer (28') and an hour indicator (26), also transparent except in the area of a reading pointer (26'), said indicators and dial having a common geometric axis (Y) and being carried by a frame or surround (20) and at least part of these indicators and dial having teeth a their periphery, masked by the surround (20), for driving them in rotation in relation to the surround (20) about said axis (Y) characterised in that it also includes:

a fixed frame (2) having a fixed geometric axis (X) and movingly carrying said surround (20), first driving means (19, 19') for rotating said surround (20) and said dial and indicators which it carries, about said axis (X), in a pre-determined direction and at a predetermined angular speed and second driving means (17,22, 17',22', 32,33) for rotating a part at least of said dial (10), minute indicator (28) and hour indicator (26) by their periphery in rotation about said axis (y) of said surround (20), in order that said indicators (26,28) turn, one in relation to the other and relative to the dial (10), for instantaneous indication of the time due to the relative angular position of said indicators in relation to said dial.

2. A clock as claimed in claim 1, characterised in that the second driving means are arranged so that the dial (10) remains in a fixed angular position.

3. A clock according to claim 1, characterised in that the second driving means co-operate, by gearing, with a fixed, toothed annular ring (17,17') carried by said fixed frame (2).

4. A clock according to claim 3, characterised in that the second driving means comprise a gear train (22,22') and at least one input gear wheel (23) and at least two output gear wheels (24 , 25, 24',25') co-operating by gearing respectively with the toothed annular ring (17,17') and the toothed periphery of at least part of said dial and indicators (10,26, 28) carried by said surround (20).

5. A clock according to claim 4, characterised in that the gear train of (22) extends between the toothed annular ring (17) and the toothed periphery of at least a part of said dial and indicators (10, 26, 28), this train being carried by a moving element (4) fixedly supporting the surround (20) and being masked by a decorative element (6').

6. A clock according to claim 4, characterised in that the surround (20) is substantially tangential to the fixed frame (2) and in that the gear train (22') is carried by a moving element (4) fixedly supporting the surround (20) and is partially accommodated within the fixed frame (2) and partially within the surround (20) in the tangential area (8) of the fixed frame (2) and of the surround (20).

7. A clock according to claim 1, characterised in that the second driving means include at least two floating, toothed annular rings (33) accommodated within the fixed frame (2) and each co-operating, on the one hand, with the toothed periphery of one of said dial and indicators (10, 26, 28) carried by the surround (20) and, on the other hand, with a driving gear (32) accomodated in the fixed frame (2).

8. A clock according to claim 1, characterised in that it includes a moving element (4) including a first part (5) for indicating the time and a second part (6) masking a part (22) of said second driving means (17, 22) and extending from said first part (5) as far as an inner contour (7) of the fixed frame (2).

9. A clock according to claim 8, characterised in that said second part (6) of the moving element (4) is transparent or free of matter except in an area (6') masking said part (22) of the second driving means.

10. A clock according to claim 1, characterised in that said geometric axes (X) and (Y) are the same or different, the surround (20) being in the latter case tangential to an inner contour (7) of the fixed frame (2) or spaced from the latter.

11. A clock according to claim 1, characterised in that the first driving means (19, 18') are arranged so as to drive the surround (20) and the dial and indicators which it carries in a clockwise direction, from the observer's point of view, at an angular speed of 1/12th of a revolution per hour, in that the hour indicator (26) is integrated with said surround (20) and in that the second driving means include an output gear wheel (24) for the minute indicator (28) and an output gear wheel (25) for the dial (10).

12. A clock according to claim 1, characterised in that the first driving means are arranged so as to move the surround (20) and the dial and indicators which it carries in a clockwise direction, from the observer's point of view, at an angular speed of one revolution per hour, in that the minute indicator (28) is integrated with said surround (20) and in that the second driving means includes an output gear wheel (24) for the hour indicator (26) and an output gear wheel (25) for the dial (10).

13. A clock according to claim 1, characterised in that the second driving means (17, 22; 17', 22'; 32,33) are arranged to rotate the minute indicator (28), in relation to the surround (20) at an angular speed ($V_{mn}$) expressed in revolutions per hour, the hour indicator (26) at an angular speed ($V_h$) expressed in revolutions per hour and the dial (10) at an angular speed ($V_c$) expressed in revolutions per hour, according to the following ratios:

$$V_{mn}=1-\epsilon V_l$$

$$V_h=1/12-\epsilon V_l$$

$$V_c=-\epsilon V_l$$

in which $V_l$ is, expressed in revolutions per hour, the positive numeric value (absolute value) of the angular speed of said surround (20) about the axis (X), $\epsilon$ has a value of +1 if the surround (20) turns in a clockwise direction and of −1 if it turns in an anti-clockwise direction, the speeds $V_{mn}$, $V_h$ and $V_c$ being positive for a clockwise rotation and negative for an anti-clockwise rotation in relation to the surround (20).

14. A clock according to claim 1, characterised in that the fixed frame (2) displays a circular opening (3) in which said surround (20) and the dial and indicators which it carries, turn about said fixed axis (X) of the fixed frame (2), the surround (20) being part of a moving element (4) extending at least partially to an edge of said circular opening, this moving element (4) being transparent or free of matter outside said surround (20), except in at least one area (6') masking said first and or second driving means.

15. A clock according to claim 1, characterised in that at least one part of said dial and indicators (10, 26, 28) consist of transparent circular disks bearing marking or reference markers.

16. A clock according to claim 1, characterised in that one of said indicators is formed by an indication pointer carried fixedly by the surround (20).

* * * * *